US007834721B2

(12) United States Patent
Juri

(10) Patent No.: US 7,834,721 B2
(45) Date of Patent: Nov. 16, 2010

(54) SYSTEM AND METHOD FOR TUNING MULTICAVITY FILTERS

(75) Inventor: Bertelli Juri, Chiavenna (IT)

(73) Assignee: CommScope Italy S.r.l., Agrate Brianza (IT)

( * ) Notice: Subject to any disclaimer, the term of this patent is extended or adjusted under 35 U.S.C. 154(b) by 146 days.

(21) Appl. No.: 12/142,540

(22) Filed: Jun. 19, 2008

(65) Prior Publication Data

US 2009/0002100 A1 Jan. 1, 2009

(30) Foreign Application Priority Data

Jun. 26, 2007 (IT) ..... MI2007A001276

(51) Int. Cl.
*H01P 1/205* (2006.01)
*H01P 7/00* (2006.01)

(52) U.S. Cl. ..... 333/202; 333/203

(58) Field of Classification Search ..... 333/202, 333/203, 205, 206, 207
See application file for complete search history.

(56) References Cited

U.S. PATENT DOCUMENTS

| | | | | |
|---|---|---|---|---|
| 6,559,740 | B1 * | 5/2003 | Schulz et al. | 333/202 |
| 6,664,872 | B2 * | 12/2003 | Channabasappa et al. | 333/202 |
| 7,486,161 | B2 * | 2/2009 | Li et al. | 333/202 |
| 2005/0040916 | A1 | 2/2005 | Park et al. | |
| 2006/0139128 | A1 | 6/2006 | Ala-Kojola | |

FOREIGN PATENT DOCUMENTS

| | | |
|---|---|---|
| GB | 1 323 496 | 7/1973 |
| WO | WO-2004/084340 A1 | 9/2004 |
| WO | WO-2005/122323 A1 | 12/2005 |
| WO | WO-2006/058965 A1 | 6/2006 |

* cited by examiner

*Primary Examiner*—Dean O Takaoka
(74) *Attorney, Agent, or Firm*—Dickstein Shapiro LLP

(57) ABSTRACT

The invention refers to a system and method to tune a multicavity filter of microwave signals, said filter comprising a filter body (CF), a removable lid (CO), n resonant cavities dug out in said filter body (CF) and n tuners (TU) susceptible of displacement under the action of movement means. Typically a sub-system to absorb the oscillations and vibrations generated in such displacements is associated to each tuner.

9 Claims, 7 Drawing Sheets

SYSTEM AND METHOD FOR TUNING MULTICAVITY FILTERS

FIELD OF THE INVENTION

This invention refers to a system for selectively tuning multicavity filters of high frequency signals (HF), in particular microwave filters.

More particularly, the invention refers to a system for the selective tuning of simple or multiple microwave filters that include at least: —a body filter (CF); —a removable body filter lid (CO); —n resonant cavities (CA) made into (CF); —n resonators (R) placed in the center of each cavity CA; —n tuners (TU), each consisting of a rod passing from outside the filter lid and penetrating inside the cavity in correspondence to each resonator; —means (SL) to move the said tuners (TU).

The invention comprises also an advantageous and therefore preferred method for the embodying of the system.

TECHNOLOGICAL BACKGROUND

To have a microwave filter satisfying the electrical specifications in terms of insertion loss within the pass band filter and of rejection of undesired signals outside the pass band, it is necessary that each cavity be carefully tuned and that the intensity of the coupling between different cavity be sufficient but not exceeding a well defined limit.

Usually regulating means are introduced for each resonator and between any contiguous cavity: tuning properly these means, typically in the form of screws that pass through the lid and stick inside the body filter for a proper quote, makes the desired frequency response possible to be obtained.

It is known from experience that the manual tuning process is time consuming and quite expensive. It is also known that a filter could be tuned in different frequency bands by simply changing synchronously the resonant frequency of each cavity, maintaining the same coupling strength.

It follows that getting a selective filter tuned in translated bands with the same electric response is possible by simply changing synchronously each cavity's natural frequency.

From an industrial point of view, this technology is needed both for having a flexible design capable of being tuned on customer demand and for the cost reduction related to the manual tuning process.

Moreover, these devices can be remotely tuned even when already deployed on the field, by means of electronically controlled stepper motors.

STATE OF THE ART

Microwave multicavity filters are nowadays widely used thanks to the large spread of the mobile communication.

In general, multicavity combiners are made of TX filters for the transmission of signals and RX filters combined with amplifiers for the reception of signals, lightning protection circuit, etc. etc.

The Applicant (that is a leader supplier in this field) described multicavity filters in many patents, among them we would limit ourselves to mention the Italian patent no 1284538, no 1283662, no 1301857 and, in particular, no 1293622, dealing with the well-known TMA (Tower Mounted Amplifier).

In the International Patent Publication WO2004/084340, tuning systems with movable "tuners" combined with means for the longitudinal shift have been presented, but despite their many merits, it seems that they haven't reached the desired commercial success.

In fact these mechanisms present some drawbacks both from a mechanical and an electrical point of view, among them we mention that the movable tuner shifting device is seldom mechanically unstable during the movement, therefore the necessary synchrony of the natural frequency of each cavity is compromised and so is the tuning of the filter.

Moreover the reciprocal position of the single tuners assembled on the slide is fixed and not modifiable, that is the filter frequency response cannot be shifted, especially when the topology of the filter is complex because of cross-couplings and of transmission zeros. For these reasons and not for chance, a second international patent publication WO2005/122323 with improved capabilities has followed the aforesaid WO2004/084340.

SUMMARY OF THE INVENTION

The first purpose of the present invention is to provide a system of tuners associated to moving devices free from inconveniences, in particular from mechanical instability.

More specifically, the invention provides a system able to compensate the oscillations and the shakes to which are submitted the tuners during their sliding on the filter's lid, by means of suitable compensating devices and dynamic stabilizers.

Indeed the vibrations and the oscillations, even though small in a absolute sense, cause undesirable high frequency disturbs that adds pass-band insertion losses and worse out of band rejections.

The stabilizing system is designed to compensate both the vibrations produced during the slide movement and the mechanical tolerances inherent to the industrial production of the filter's lids and into the filter assembly process.

In accordance with an aspect of the invention, the system provides a mechanism for the mechanical stability that furthermore adds a degree of freedom for the positioning of the single elements mounted on a slide by means of a simple clamping device. In particular, the aforesaid system allows the regulation of the distance between single tuners while maintaining the stability of the whole tuning system.

This feature allows to adapt the frequency shift of each cavity independently, as requested in case of filters with transmission zeros.

Furthermore, it is important to carefully choose the right material to bring about said devices. From a mechanical point of view, it is important to choose light material with low friction and with a low thermal expansion coefficient in order to be able to slide fluently on the filter's lid and not to stick when the temperature rises.

From an electrical point of view, it is important to choose "transparent" RF material, that is isolating material characterized by dissipation coefficient which do not worsen the insertion losses.

From an industrial point of view, it is important to orient the solution towards materials which assure the best repeatable realization of every single device, the purchasing easiness, and the stability versus time consumption of the mechanical and electrical characteristics, even when the storage is not optimum.

The more important characteristics of the invention (system and method) are recited in the claims at the end of this specification, which are to be considered incorporated.

BRIEF DESCRIPTION OF THE ACCOMPANYING DRAWINGS

The different aspects of the invention and its advantages will result more clearly from the description of the particular realization represented (to illustrative and not limitative title) in the accompanying drawings in which.

DETAILED DESCRIPTION OF THE INVENTION

Figure 1:
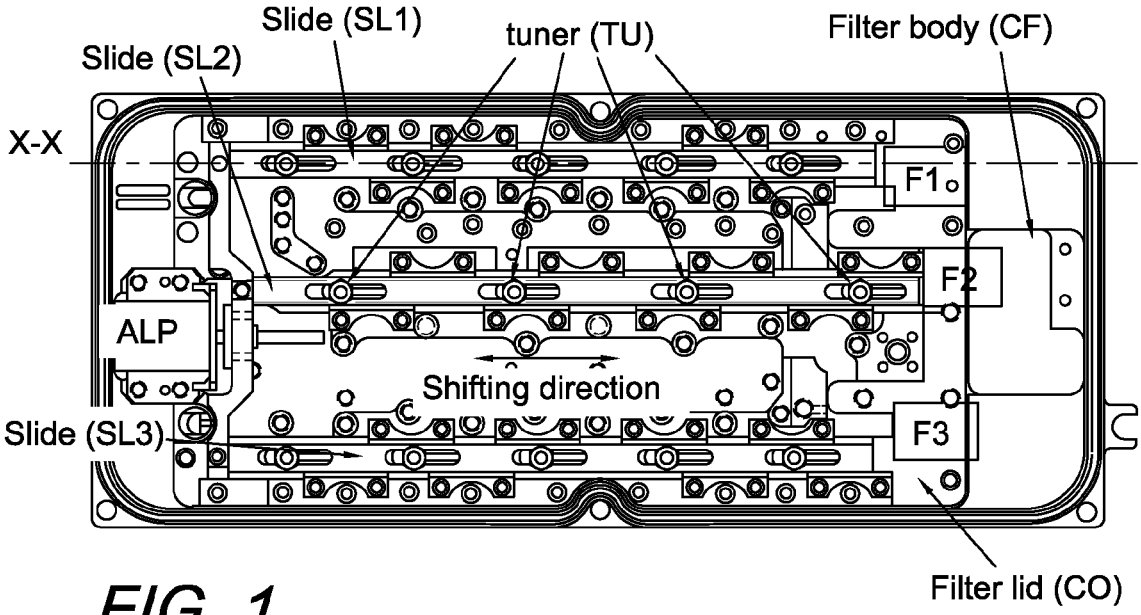
FIG. 1 represents a top view of a complex multicavity filter with three sections made of a filter body (CF) with cover (CO)

FIG. 1 represents an exploded view of a multicavity filter F, made of a body filter CF in which resonant cavities CA and resonating rods R are drawn, and of a filter lid CO; tuner's moving means are assembled on the external face FE of the lid.

FIG. 1 shows a top view of a system made of three filters (TX-RX), F1, F2, F3, each full-filling the hereby exposed criteria: note the three slides SL1, SL2, SL3, associated to their respective filter F1, F2, F3, that are able to shift horizontally (arrow W) on the filter's lid CO. In this particular and preferred embodiment, the slides SL1, SL2, SL3, are electronically controlled by a high precision linear actuator ALP.

Figure 2:
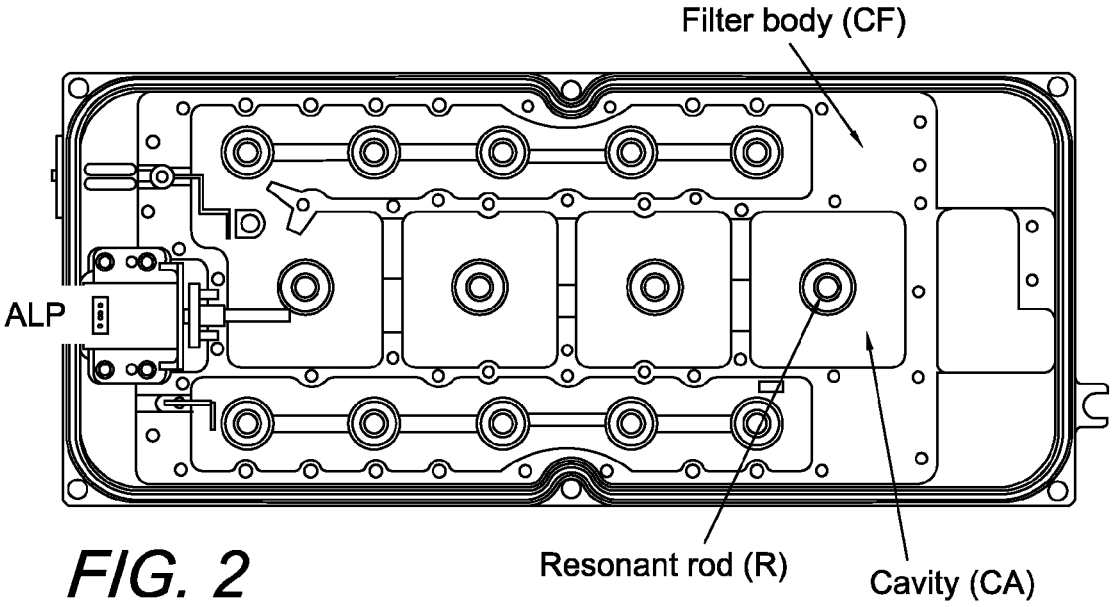
FIG. 2 represents a top view of the filter body (CF) without cover (CO)

FIG. 1 and FIG. 2 represent respectively a top view of the above mentioned system without the lid and the exploded view that highlights the assembly process.

Figure 3:
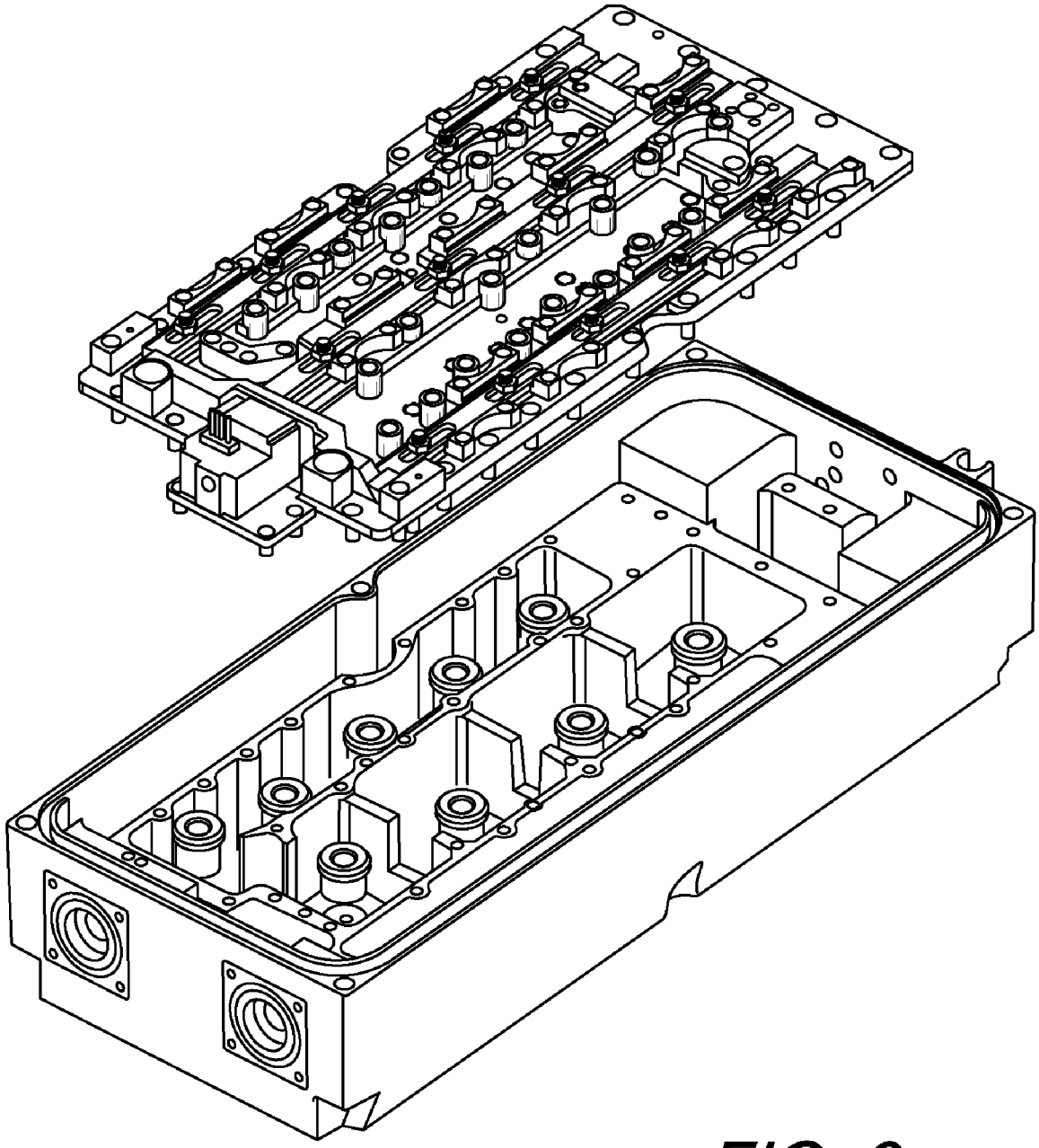
FIG. 3 represents a perspective view of the filter as in FIG. 1 and FIG. 2, with an exploded view of the filter's lid (CO) provided with n tuners (TU) (in that case n=14) and with relative shifting means, here named slides (SL)
Figure 4:
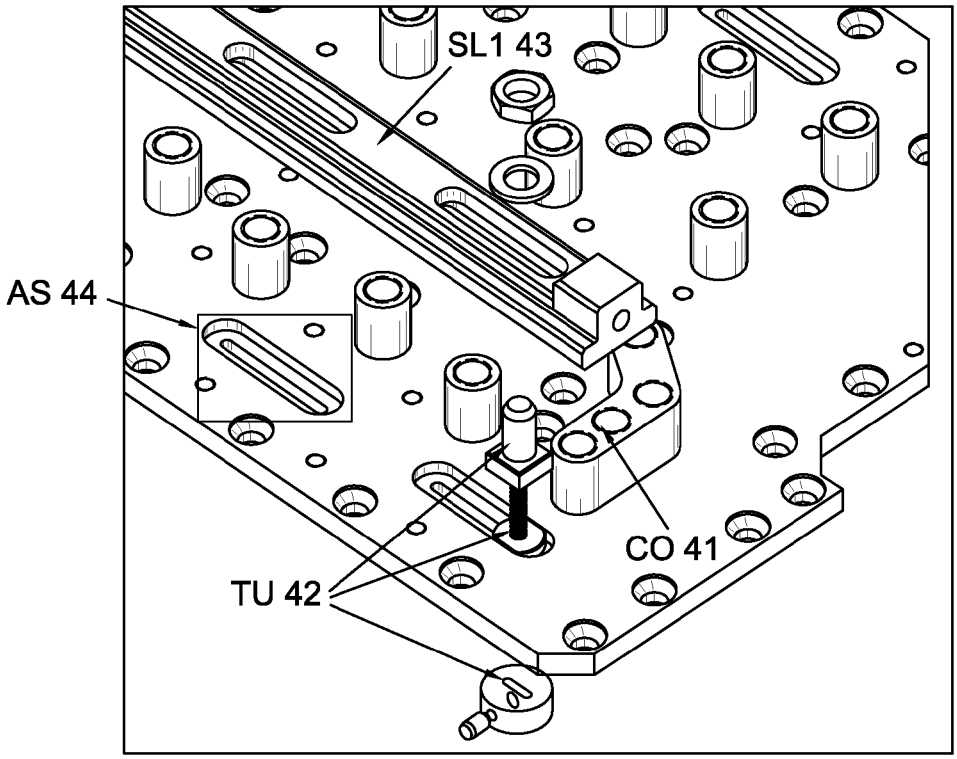
FIGS. 4 and 5 represent partial views of the lid from outside (FIG. 4) and inside (FIG. 5)

FIG. 4 shows a sampled filter lid CO (41) with an exploded view of the elastic tuner TU (42) and the slide SL1 (43) by means of which the aforesaid tuner can slide in the W arrow direction (FIG. 3).

Preferably the filter's lid CO is made of silver plated aluminum to enhance its conductivity property.

In relation to the vertical axis of any resonation rods, as many slots as the number of the cavities are drawn into the filter lid CO, and in each slot is placed one tuner TU able to absorb any vibration.

According to an aspect of the invention, the shape and the dimension of said slots are designed in order to obtain a tuner's shifting range wide enough to cover all the required frequency bands and at the same time to guarantee high spurious isolation outside the cavities CA.

In particular, the slot (AS) length in the filter's lid should not exceed the half of the cavity's side LA, and should be large enough to guarantee a high capacitance value when coupled with the tuner's face (PA) proximal to it. In this way a virtual grounding effect is carried out between the faces of the tuner and the filter's lid.

The virtual grounding assures the less energy dissipation and so the less insertion loss.

The double level groove SC (44) is useful as tuner guide and should be made in an accurate mode in order to eliminate the backlash of the sliding tuning device along the W arrow direction.

Figure 5:
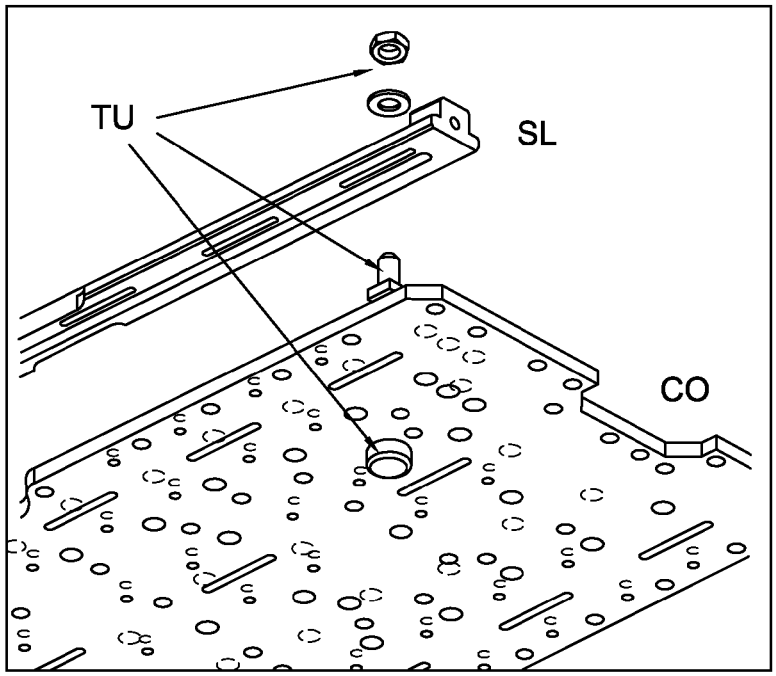
Figure 8:
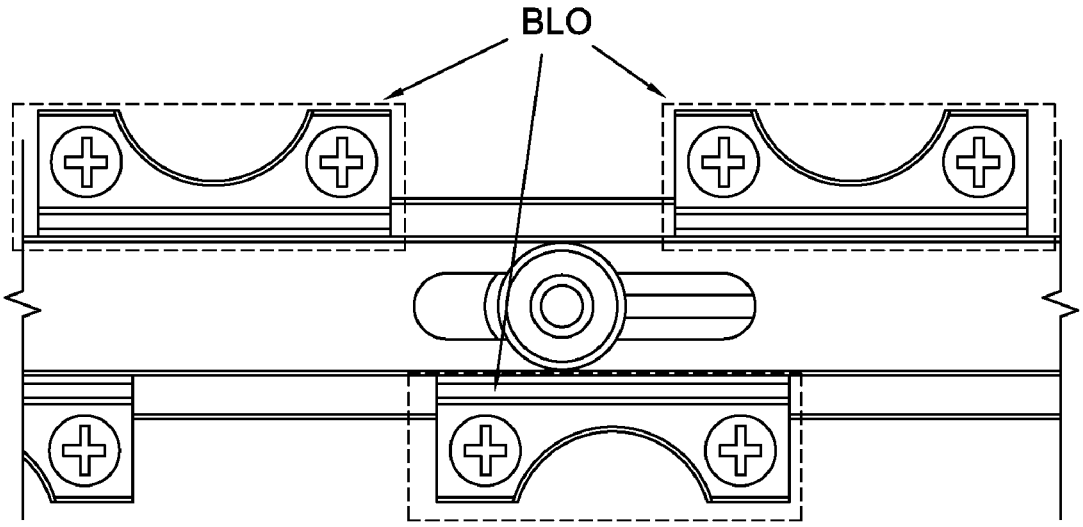
FIG. 8 represents a top section of the slide's blocking system placed on the external face of the filter's lid.

FIG. 5 shows a bottom view of the filter's lid CO with the slide assembled SL and a tuner TU. In order for the slide to run on the filter's lid accurately along a unique axis, it is necessary to guide its movement by means of fixing blocks (BLO in FIG. 8) that bind its movement in horizontal and vertical sense, because they partially overlay the slide by suitable grooves.

Figure 13:
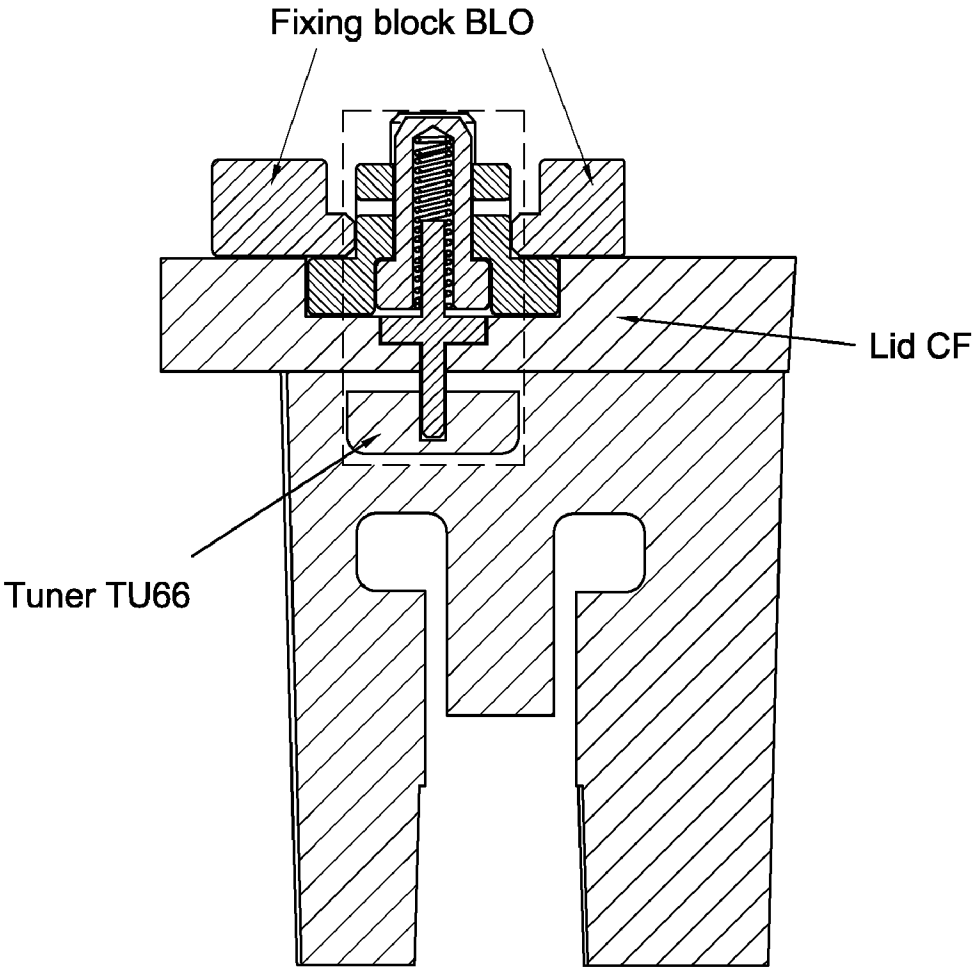
FIG. 13 is a cross-section of assembled elements of FIG. 12.

FIG. 13 shows the cross-section of a generic resonant cavity CA with its lid. A grooving SC is drawn in it so that tuners can pass through and the slide can run along. Fixing blocks BLO are assembled on the filter cover. The fixing blocks should not produce friction between the lid's surface and the slide.

Figure 12:
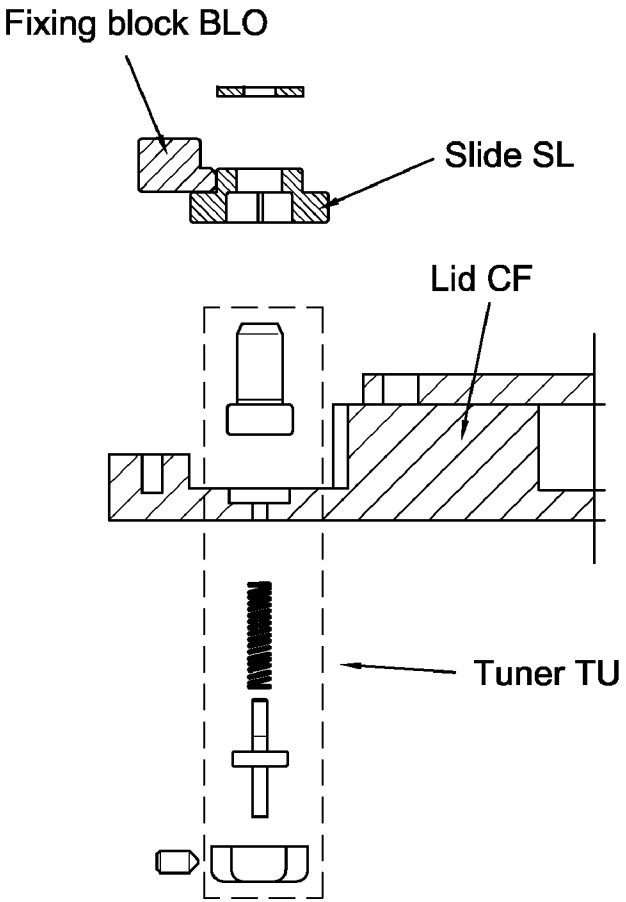
FIG. 12 is a lateral exploded cross sectioned view with a plane Y-Y of FIG. 11.

FIG. 12 shows an exploded view of the preferred embodiment of the system according to the invention.

The shape and the material selection of the slide and of the fixing blocks is critical.

It has been found that "etherimmid" polymer based materials, such as ULTEM (trademark by General Electric), full-fill the following requirements:

- Low friction on high porosity planes, such as silver plated aluminum plates;
- Good mechanical flexibility, that translates in manufacturing easiness and torsion strength;
- Good temperature behavior thanks to the same thermal expansion coefficient of the aluminum; this feature prevents from additional friction introduced by temperature changes;
- Low specific weight;
- High mechanical stability when subjected to strong mechanical stress.

The experience has shown that the best solution is to have the slide SL and the fixing blocks BLO made with ULTEM2300 (registered trademark), that is partially carbon charged.

Another suitable solution is to have the slide and the fixing blocks made of aluminum which have to be submitted to a surface coating treatment based on fluoride derivatives.

In this case, the fluoride surface prevents from high friction and the aluminum make the devices stable versus temperature.

The main drawbacks are the consumption of the surface treatment and the higher weight of the moving device.

According to the invention, the system aims to guarantee the fluid run of the tuners in their movement direction, avoiding any friction and any displacement orthogonal to their moving direction.

It is also important to assure the tuners mechanical stability respect to the vertical direction, that is to assure the tuners penetration quote (H in FIG. 9) inside of the cavity respect to the lid's surface.

According to an advantageous aspect of the invention, as pointed out in the introduction, we confirm the importance of having each tuner displaced independently on the slide, in order to have each cavity independently tuned.

The hereby invention aims to solve all these issues.

Figure 6:
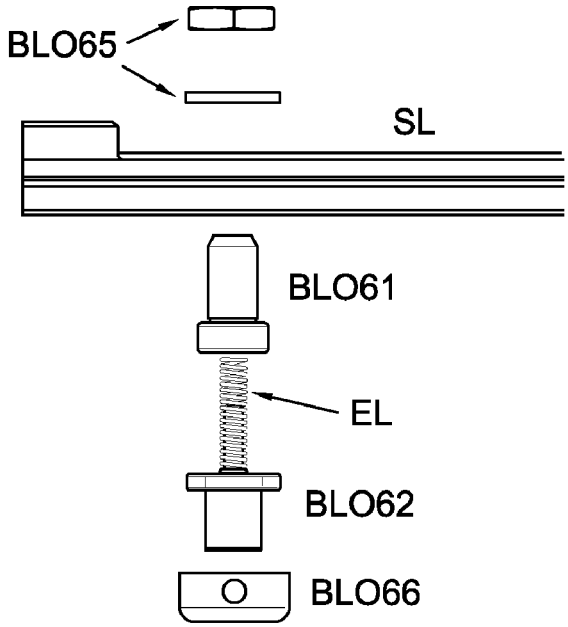
FIGS. 6 and 7 represent exploded frontal views of a single tuner (TU) with slide SL (FIG. 6) and without slide (FIG. 7), with enlarged central block (BLO 61, BLO62, EL)

FIG. 6 shows a lateral view of the slide SL (63) and the tuner TU disassembled into its fundamental part.

The device (here called tuner TU) is made of five different elements, each equally important to achieve the aforesaid targets.

The "ensemble" blocks BLO61 (head) and BLO65 of FIG. 6 work together for fixing the tuner on the slide. When shifting, the slide makes all the tuners change their position synchronously.

The element BLO61 is made of a threaded cylinder portion and a rectangular part below engaging in a correspondent hole (niche) NI obtained in the slide.

The element BLO61 is a threaded nut that can block the cylindrical part.

In the proposed embodiment, the nut itself sinks in a slide's niche NI to reduce the vertical dimension.

The inferior portion BLO62 is the tuner part (TU66) that passes through the slots AS of the filter lid's (CO). The superior part is designed in order to fit perfectly into the filter lid's groove that act as a guidance. The inferior part pass through the cover and the tuning element TU66 can be assembled on it.

As previously mentioned, the BLO61, BLO62, BLO63 are made of an amorphous thermoplastic resin called ULTEM.

For the tuner TU66, the prior conventional technique suggested the use of dielectric materials or a combination of them.

The main problem is that high dielectric factor ceramics are needed in order to obtain the right frequency shift. High dielectric factor ceramics have also high dissipation factor, therefore high RF losses.

Moreover, suitable ceramics are usually expensive and hard to be found on the market.

The solution proposed by the invention solves the aforesaid problems being made of a silver plated tuner TU66.

The appropriate frequency drift is determined by the penetration quote into the cavity and by the shape of the tuner itself, that need to be properly designed.

Furthermore, the current distribution on the tuner's surface has a low impact on the RF losses.

Figure 9:
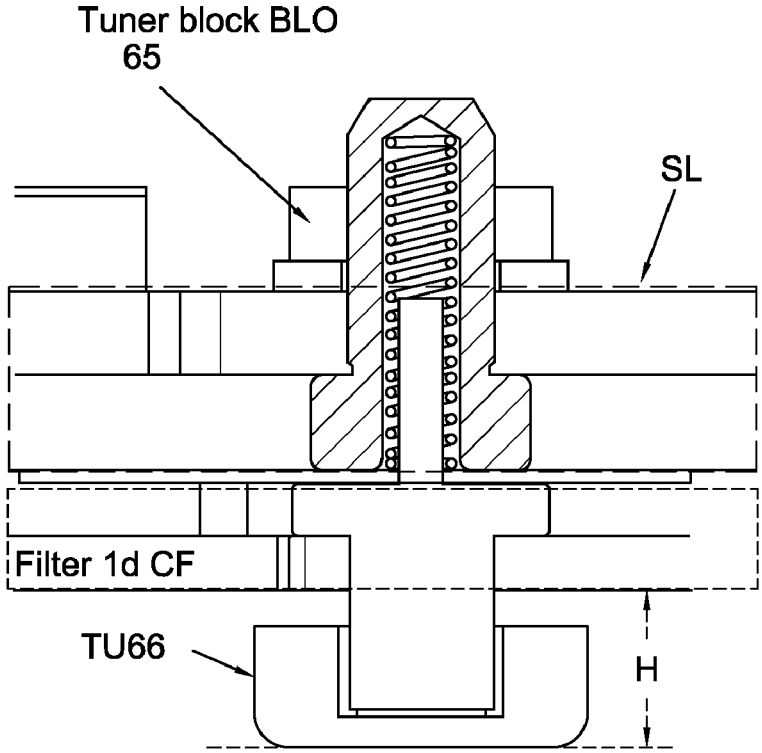
FIG. 9 represents a cross section view of the assembled system made of a slide SL and a tuner TU, blocked on it by means of blocking devices (BLO)

FIG. 9 shows in detail a cross-section of the tuning system.

As pointed out in the introduction, the distance between the surface of the cavity tuner (TU66) and the lid surface (quote H in FIG. 9) must be steady, in order for the device to work properly during the shifting movements.

Figure 10:
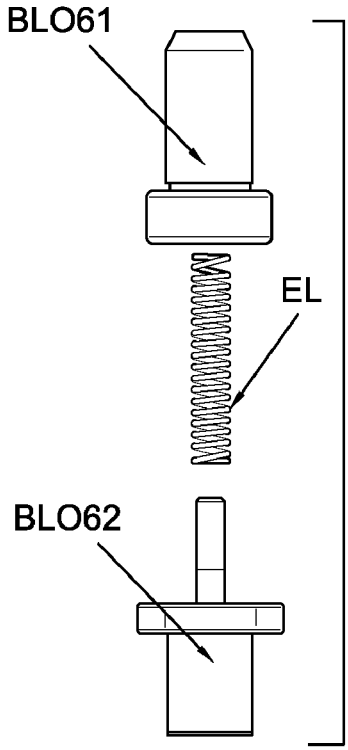
FIG. 10 represents an exploded view of the elastic system according to the invention.
Figure 11:
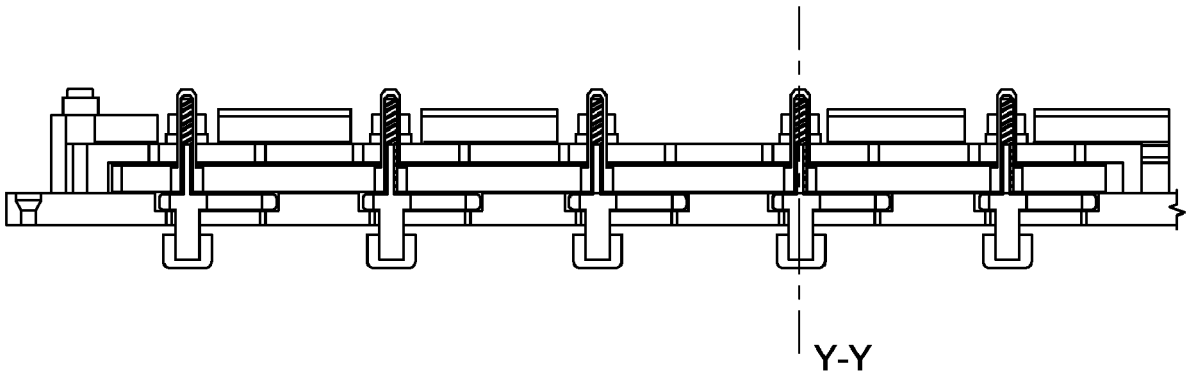
FIG. 11 represents a frontal view of the filter's lid CO assembled with its slide SL, five tuners TU and their blocks (BO), said view being a cross-section having as a trace the line X-X of FIG. 3.

The elements suited to dynamically balance the tolerances due to the assembly process and the mechanical vibrations are shown in the exploded view in FIG. 10.

In particular the element BLO61 is bound to the slide by a blocking device.

The element BLO62, working as a support of the tuner, can shift into the filter lid's slots and can maintain its position thanks to an elastic constraint (EL). The vibrations caused by the movement are compensated by the aforesaid elastic device, in this case represented by a spring.

The mechanical features of the spring should be considered for the best elastic subsystem design (EL in FIG. 10).

In particular, the spring parameters to be considered are the material, the thread diameter, the number of coils per length unit, its steady length and its compression range.

According to the mechanical constraints, the design of the device associated to the spring (FIG. 10, BLO61, BLO62) has to assure that the spring can work in its linear compression range during the slide movement, so that a constant pressure can be applied to the part BLO62 of FIG. 10.

The elastic pressure stands between the tuner's support BLO62 and the filter's lid slots.

The compression strength depends on the thread diameter, on the number of coils and on the spring steady state length.

If the compression strength is too strong, the friction between tuners and cover increases and a block could happen.

On the contrary, if the compression strength is too weak, no vibration can be compensated and the tuner can vertically sway.

On the basis of the analyzed application the preferred material is the stainless steel because is stable in time, it's not subjected to the wear and tear of the time and it's stable versus temperature.

Figure 14:
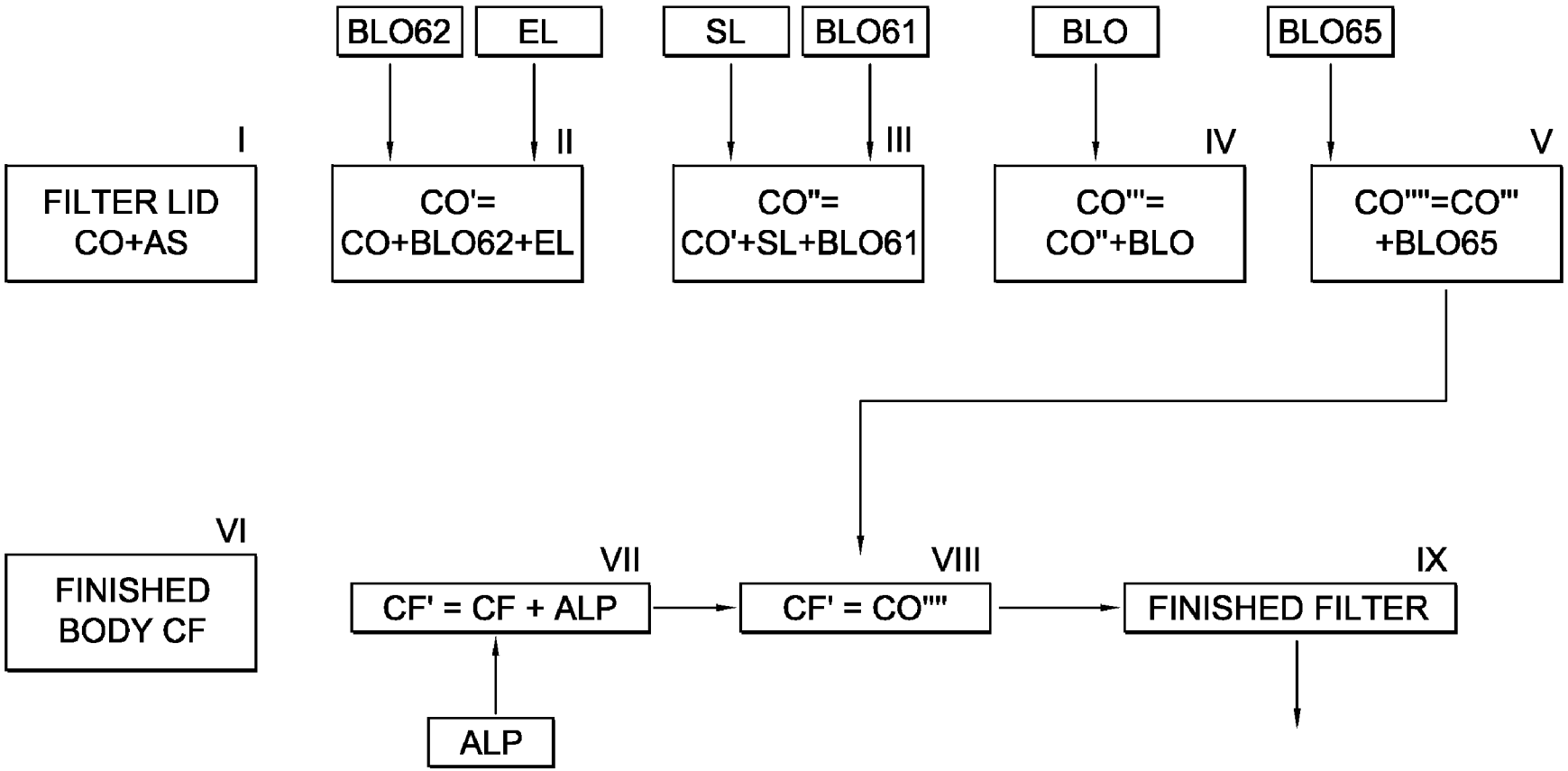
FIG. 14 represents a block diagram illustrating the preferred assembly method of the filter according to the invention.

An advantageous and therefore preferred manufacturing method is represented in the block diagram of FIG. 14.

The starting point is a filter body CF and a filter lid CO with slots AS provided therein.

Figure 7:
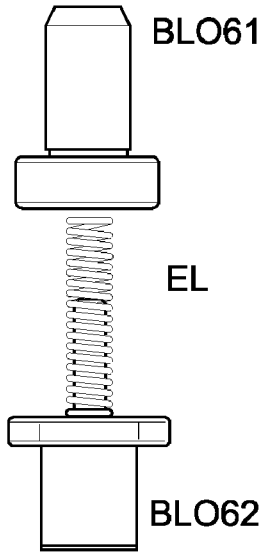

As shown in FIG. 6 and FIG. 7, the block BLO62 and the elastic element EL are inserted into the filter cover slots CO+AS. The result is the component CO'=CO+BLO62+EL.

From block II the filter lid passes to block III, in which it is provided with the slide, previously assembled with BLO61, that is the tuner's heads, obtaining CO"=CO'+SL+BLO61.

CO" goes to block IV where the slides SL are fixed to the filter lid by means of BLO (FIG. 8), yielding CO'"=CO"+BLO.

CO'" run to block V where is equipped with BLO65, that is the tuner's blocks, here represented by nuts and possibly flat washer (FIG. 6).

The filter body passes in parallel from block VI to block VII, where a moving device ALP, that is a high precision linear actuator, is mounted, yielding CF'=CF+ALP.

In block VIII the body filter CF' is assembled to its cover CO'" coming from block V.

Block VIII yields the complex multicavity filter according to the invention.

For illustration clarity scruple the invention has been described with reference to the preferred embodiment shown in the accompanying drawings, which are however susceptible of all the modification and additions, which being obvious to the mean field expert, are to be considered as comprises and/or falling within the scope of the following claims.

What is claimed is:

1. System for tuning a simple or complex multicavity high frequency and microwave filter, including a body filter; a removable lid; n resonant cavities in said body filter; n resonant rods, disposed in the middle of each cavity; n tuners passing through the filter lid in correspondence to each resonating rod and tuner moving device, characterized in that:

a subsystem is associated with each tuner to compensate for vibrations and oscillations; and the lid is provided with n slots, which are longitudinally placed over the middle of the cavity and have a length sufficient to assure the tuning in every frequency band.

2. System according to claim 1, in which the subsystem comprises means for longitudinal translation of said tuners and means for making the tuner components elastic.

3. System according to claim 2, in which the longitudinal translation means are slides associated to a motor device and the means for making the tuner components elastic comprises a shock absorber made of a helical spring orthogonal to the slide axis.

4. System according to claim 1, in which the tuner is made of a plurality of elements, including a head and a nut for blocking movement of the tuner on a slide, said head being formed of a threaded cylinder and of a rectangular element which penetrates into a corresponding niche in the slide in order to reduce a vertical dimension of the system.

5. System according to claim 1, in which an inferior portion of each tuner passes through the slot, and a superior portion of each tuner is engaged into a groove of a cover of the filter.

6. System according to claim 4, in which the head and nut are made of polyetherimide polymer.

7. System according to claim 4, in which blocks, overlay the slide in corresponding grooves, fixing movement of the slide in vertical and horizontal direction.

8. System according to claim 1, in which by means of stabilizing subsystem, mechanical tolerances due to the assembly process and vibration related to the movement are compensated.

9. System according to claim 4, in which the elements for blocking the tuner on the slide control cavity frequency response.

* * * * *